US010821352B2

(12) United States Patent
Kijashka

(10) Patent No.: US 10,821,352 B2
(45) Date of Patent: Nov. 3, 2020

(54) TOY

(71) Applicant: Elizabeth Abigael Kijashka, Ellen Grove (AU)

(72) Inventor: Elizabeth Abigael Kijashka, Ellen Grove (AU)

(73) Assignee: ESKP3 PTY LTD, Forest Lake (AU)

( * ) Notice: Subject to any disclaimer, the term of this patent is extended or adjusted under 35 U.S.C. 154(b) by 0 days.

(21) Appl. No.: 16/312,927

(22) PCT Filed: Jun. 21, 2017

(86) PCT No.: PCT/AU2017/050625
§ 371 (c)(1),
(2) Date: Dec. 21, 2018

(87) PCT Pub. No.: WO2018/000022
PCT Pub. Date: Jan. 4, 2018

(65) Prior Publication Data

US 2019/0168111 A1 Jun. 6, 2019

(30) Foreign Application Priority Data

Jun. 27, 2016 (AU) ..... 2016902507

(51) Int. Cl.
*A63F 7/04* (2006.01)
*B65D 47/06* (2006.01)

(52) U.S. Cl.
CPC ..... *A63F 7/045* (2013.01); *A63F 7/04* (2013.01); *B65D 47/06* (2013.01); *A63F 2250/022* (2013.01); *A63F 2250/024* (2013.01); *A63F 2250/04* (2013.01); *A63F 2250/06* (2013.01)

(58) Field of Classification Search
USPC ..... 273/257
See application file for complete search history.

(56) References Cited

U.S. PATENT DOCUMENTS 1,045,601 A * 11/1912 Parsells ..... A63H 13/16 446/310
2,105,023 A * 1/1938 Windbiel ..... B65D 47/18 222/420
2,619,262 A * 11/1952 Barosso ..... B65D 47/18 222/420
2,781,063 A * 2/1957 Williams ..... B01L 3/0282 141/24
2,959,314 A * 11/1960 Sanchez ..... A61J 11/002 215/11.1
3,135,302 A * 6/1964 Ballin ..... B01L 3/0282 141/24
3,901,510 A * 8/1975 Demaio ..... A63F 7/382 273/113
4,310,104 A * 1/1982 Takatsuki ..... B67D 1/0425 222/131
4,317,886 A * 3/1982 Johnson ..... C12M 25/06 435/299.2

(Continued)

*Primary Examiner* — John E Simms, Jr.
*Assistant Examiner* — Dolores R Collins
(74) *Attorney, Agent, or Firm* — Adam R. Stephenson, Ltd.

(57) ABSTRACT

A product advertising and marketing toy comprising a clear or transparent receptacle resembling an empty well known or prior art beverage container. A tube extending into the receptacle, wherein shaking the receptacle to cause a token to enter the tube is the aim of using the toy. A game played using the toy.

11 Claims, 7 Drawing Sheets

(56) References Cited

U.S. PATENT DOCUMENTS

| | | | | | |
|---|---|---|---|---|---|
| 4,463,859 | A * | 8/1984 | Greene | A61J 9/00 | 215/11.1 |
| 4,583,651 | A * | 4/1986 | Ostberg | B65D 51/24 | 215/228 |
| 5,335,912 | A | 8/1994 | Brooks | | |
| 5,725,212 | A * | 3/1998 | Garrett | A63F 7/045 | 273/138.2 |
| 5,957,316 | A * | 9/1999 | Hidding | B67D 3/0032 | 141/348 |
| 7,204,382 | B2 * | 4/2007 | Cezeaux | A45F 3/16 | 215/229 |
| 7,828,165 | B2 * | 11/2010 | Brown | A61J 9/006 | 215/11.4 |
| 8,113,365 | B2 * | 2/2012 | Brown | A61J 9/04 | 215/11.1 |
| 8,642,051 | B2 * | 2/2014 | Stillman | A47G 19/2205 | 424/400 |
| 9,230,463 | B2 * | 1/2016 | Volftsun | G09F 3/00 | |
| 2001/0027956 | A1 * | 10/2001 | Bonacorso | A61J 9/00 | 215/11.1 |
| 2005/0040128 | A1 * | 2/2005 | Kong | A61J 9/001 | 215/11.3 |
| 2006/0108278 | A1 * | 5/2006 | Scholl | B01D 46/10 | 210/450 |
| 2006/0150450 | A1 | 7/2006 | Azouri | | |
| 2006/0151414 | A1 * | 7/2006 | Mullen | B65D 1/0223 | 215/227 |
| 2007/0262097 | A1 | 11/2007 | Antal | | |

* cited by examiner

TOY

CROSS REFERENCE TO RELATED APPLICATIONS

This document claims the benefit of the filing date of Australian Provisional Patent Application 2016902507, entitled "A Toy" to Elizabeth Kijashka which was filed on Jun. 27, 2016, the disclosure of which is hereby incorporated entirely herein by reference.

This application is also a Section 371 National Stage application of the earlier international Patent Cooperation Treaty Patent Application to Elizabeth Kijashka entitled "A Toy," application serial number PCT/AU2017/050625, filed Jun. 21, 2017, now pending, the disclosure of which is hereby incorporated entirely herein by reference.

BACKGROUND

1. Technical Field

This invention relates to the marketing and advertising of consumable products in particular but not exclusively to, a toy used to market and advertise bottled beverages to the juvenile and youth market.

2. Background

The use of toys as giveaways or even where offered for sale is a well-known marketing or advertising strategy used by food and drink manufacturers. For example the well-known McDonalds hamburger franchise always has toys included in its merchandising of children's meals for example its "Happy Meal" offers. Some years ago, the Coca Cola Company very successfully advertised and marketed its soft drink by offering for sale, yo-yos which started a worldwide craze and a sport. Such marketing schemes are not lost on advertising executives who are always on the lookout for new ideas and ways to sell consumable products.

While character merchandise of popular movie franchises such as Star Wars, Batman and other superheroes is tried and tested, they depend on their popularity for a limited time only. Production runs of the particular character merchandise must also be accurately timed so that the organisation investing in these marketing products will not be left holding leftover surplus and unsaleable stock. There is therefore a need for a product which can be easily and continually adapted for any popular theme, venue, time or cultural event in the interests of saving not insubstantial promotional costs. This is never so prevalent in the highly competitive market for aerated beverages where the target demographic is the youth and juvenile population. This market is invariably and universally recognised as being fascinated by gimmicky playthings and toys associated with well-known brands of soft drink.

It is desirable to provide a novel and innovative toy to market and advertise e.g. bottled beverages to the juvenile and youth market and to generally provide the public with a useful choice.

SUMMARY

In a main aspect, the invention resides in a product advertising and marketing toy including: a clear or transparent receptacle defined by a wall, the receptacle comprising a neck portion; the receptacle may in some embodiments resemble an empty well-known or prior art beverage container; a cap attached to an opening at the neck portion of the receptacle; the cap may in some embodiments resemble the cap ordinarily used with the beverage container; a tube defined by a tube wall and having at least one open end; the tube extending partway into the receptacle from the opening at the neck portion so that an open end of the tube is disposed in the receptacle, wherein a space is defined between the wall of the receptacle and the tube wall, the space being around the whole periphery of the tube wall; tokens encapsulated within the receptacle; wherein shaking the receptacle typically in side to side or an up and down motion or inversion or a combination thereof causes at least some of the tokens to enter the tube via the open end.

Advantageously, when the cap is in place and the opening at the neck portion of the receptacle is closed, inversion of the receptacle causes some of the tokens to enter the open end of the tube. Upon inversion or shaking, some of the tokens will also inevitably pass into the space defined between the wall of the receptacle and the tube wall. In an embodiment, the toy provides a game, the aim of which is to move all of the tokens into either the tube, or the space defined around the periphery of the tube. In an embodiment, the toy provides a means for removing a predetermined amount of the tokens, since only those tokens in the tube will be readily removable from the receptacle when the cap is removed and the receptacle is opened.

In an embodiment, the toy receptacle is closed and is intended to remain closed at all times including before, after and during use. When the receptacle is closed, the tokens cannot be removed from the toy. In an embodiment, the receptacle is openable. The tube may be attached to the neck portion of the receptacle and the tube can be open at both ends. Upon removal of the cap, the opening at the neck portion of the receptacle can open directly into the tube. Alternatively, the tube is attached to the cap so as to be sealed by the cap and therefore closed at one end. When the tube is attached to the cap, the cap and tube form a unitary piece which can be removed from the receptacle to release the token from the open end of the tube.

The area defined by the tube only permits a certain number of tokens to be contained within the tube before no further tokens can fit. In some embodiments, the number of tokens in the receptacle can be substantially equal to the amount that will fit into the tube. This can be determined by trial and error prior to the manufacturing process. Thus, the receptacle can comprise a game the aim of which is to move all of the tokens into the tube by shaking the receptacle, while attempting to avoid or at least reduce the number of tokens entering into the space around the outside periphery of the tube. Thus, the invention resides in a game played using the toy as herein disclosed with the objective of locating a maximum number of tokens in the tube optionally within a predetermined period of time.

In other embodiments, the number of tokens can be more or less than the number of tokens that can fit into the tube. When the amount of tokens is more than will fit into the tube, by filling the tube, the user can be certain that there is a fixed amount of tokens in the tube. This can be advantageous if the receptacle is openable, since upon opening the receptacle a fixed dose or serve of the tokens can be released to the user. The toy may thereby act as a measuring device. A measuring device can be exciting to e.g. a child who wishes to ensure that a fair or equal number of the tokens are shared with siblings or friends. In a preferred example, the tokens are edible.

The tube can be coloured or can be clear or transparent. A transparent tube can be advantageous since the user can see the enticing amount of the tokens in the tube. A coloured or opaque tube can obscure the tokens from view. Preferably, the length of the tube and/or shape and configuration of the open end of the tube is varied during manufacture to either change the amount that can be delivered by tube and or to vary the degree of difficulty in using the toy.

In addition or in the alternative, the size, and/or shape and configuration of the tokens is varied to vary the amount that can be delivered by the tube and or to vary the degree of difficulty in using the toy. The design of the toy can be varied according to the desired user experience. Suitably, the shape and configuration of the tokens reflects a contemporaneous or popular character marketing or merchandising theme.

Preferably, the receptacle is an empty well known or prior art beverage container of a beverage currently advertised or marketed. A well-known or prior art beverage container can bring to mind the beverage so that the user is later encouraged to buy a filled bottle of that beverage from a local store. Preferably, the cap or lid is an actual cap or lid ordinarily used with the beverage container. The cap or lid of a well-known or prior art beverage container can sometimes be recognisable and will further enhance the user experience since the toy may remind them of the well-known or prior art beverage company.

Alternatively, the receptacle is an empty well known or prior art food container of a foodstuff currently advertised or marketed. A well-known or prior art food container can bring to mind the food so that the user is later encouraged to buy a filled bottle of that food from a local store. The food can be a condiment such as a sauce. The tokens in the bottle may bring to mind the food, for example, the tokens could be small tomatoes.

Preferably, the tube extending from the cap or lid partway into the receptacle is coaxially aligned with the longitudinal axis of the receptacle. In an alternative example, the tube extending from the cap or lid partway into the receptacle is not coaxially aligned with the longitudinal axis of the receptacle.

BRIEF DESCRIPTION OF THE DRAWINGS

In order for embodiments of the invention to be better understood and put into practical effect reference will now be made to the accompanying illustrations, wherein.

DESCRIPTION

Figure 1:
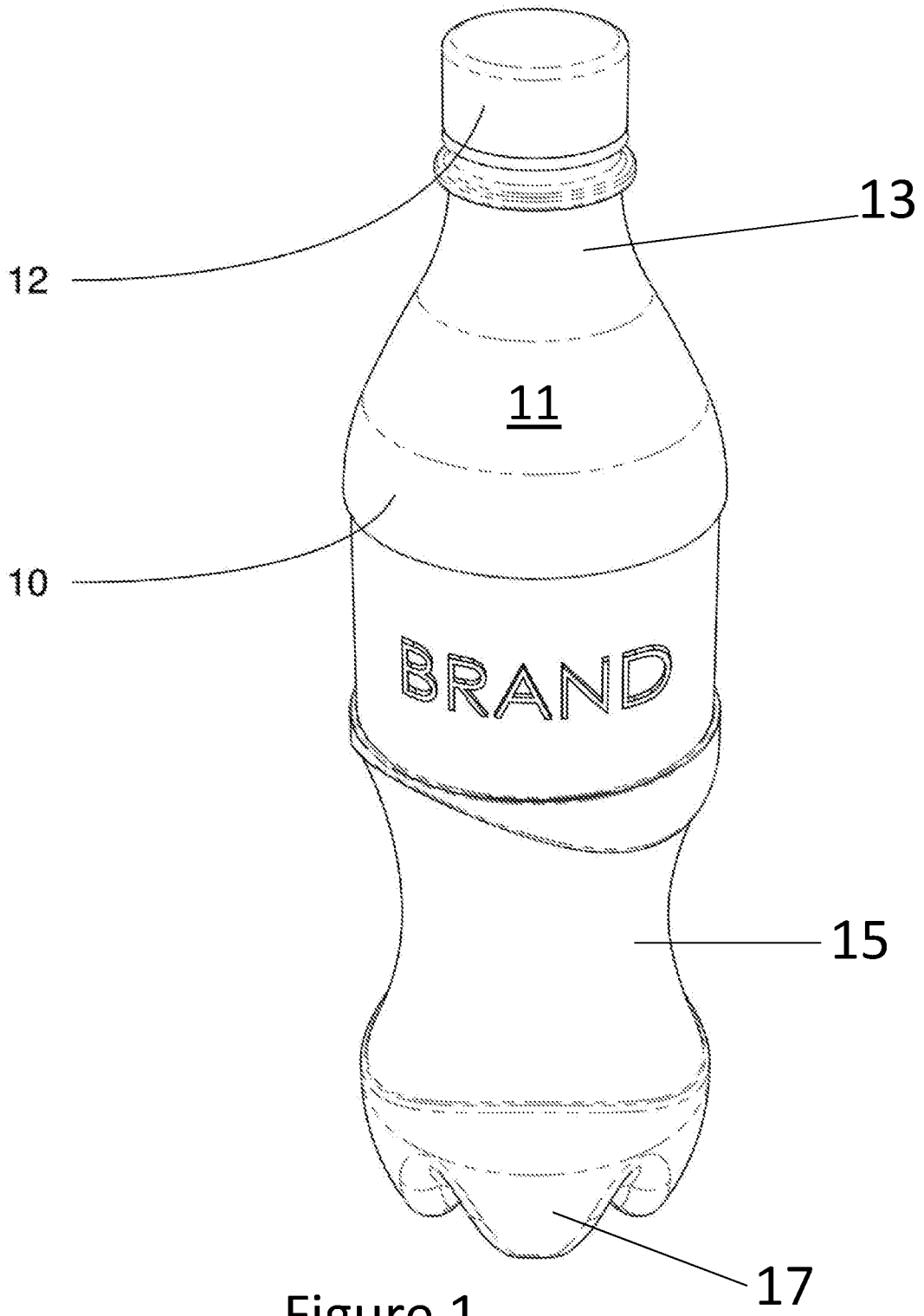
FIG. 1 shows a perspective view of an embodiment in the form of a bottle toy.

FIG. 1 shows a perspective view of the toy in the form of a bottle 10. The cap or lid 12 may be removably attached to an opening at the neck portion 13 of bottle 10. In some embodiments, the cap 12 is screw-threadly attached to the bottle 10. A childproof cap, which is more difficult to open, can be an alternative option to the screw-top cap. In other embodiments, the cap 12 is fixedly attached to the bottle 10 and is not intended to be removed. In this embodiment, the bottle is a complete entity and the lid cannot be removed or the toy opened. It is a totally safe and sealed toy to play with.

The bottle is defined by a wall 11 and has a neck portion 13. The bottle 10 has a body portion shown generally by numeral 15 and a base portion 17. The base portion 17 may allow the bottle to stand upright for display purposes, or to cause it to be upright without support when the bottle 10 is not in use.

Figure 2:
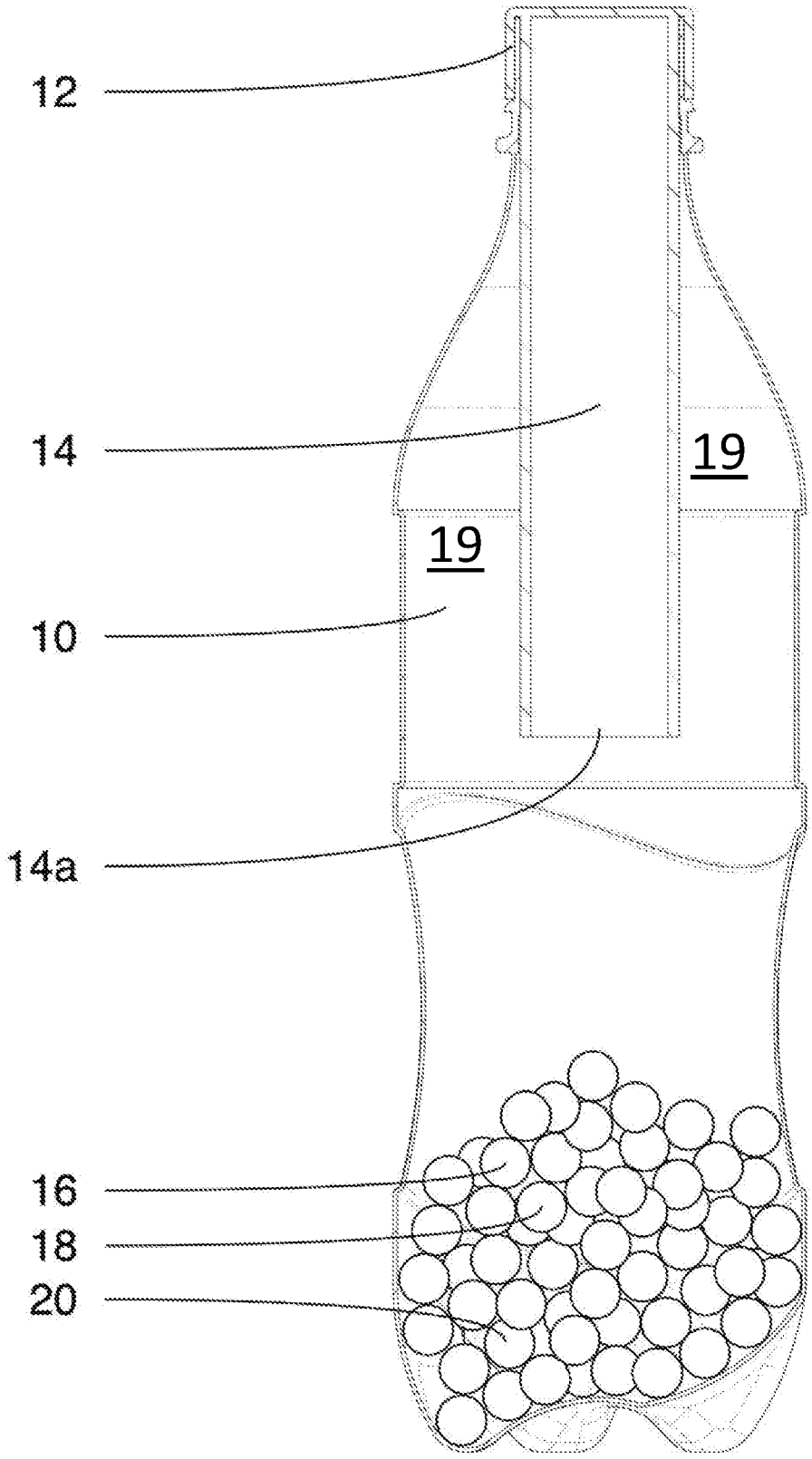
FIG. 2 and FIG. 3 show cross sectional views of the bottle toy of FIG. 1.
Figure 3:
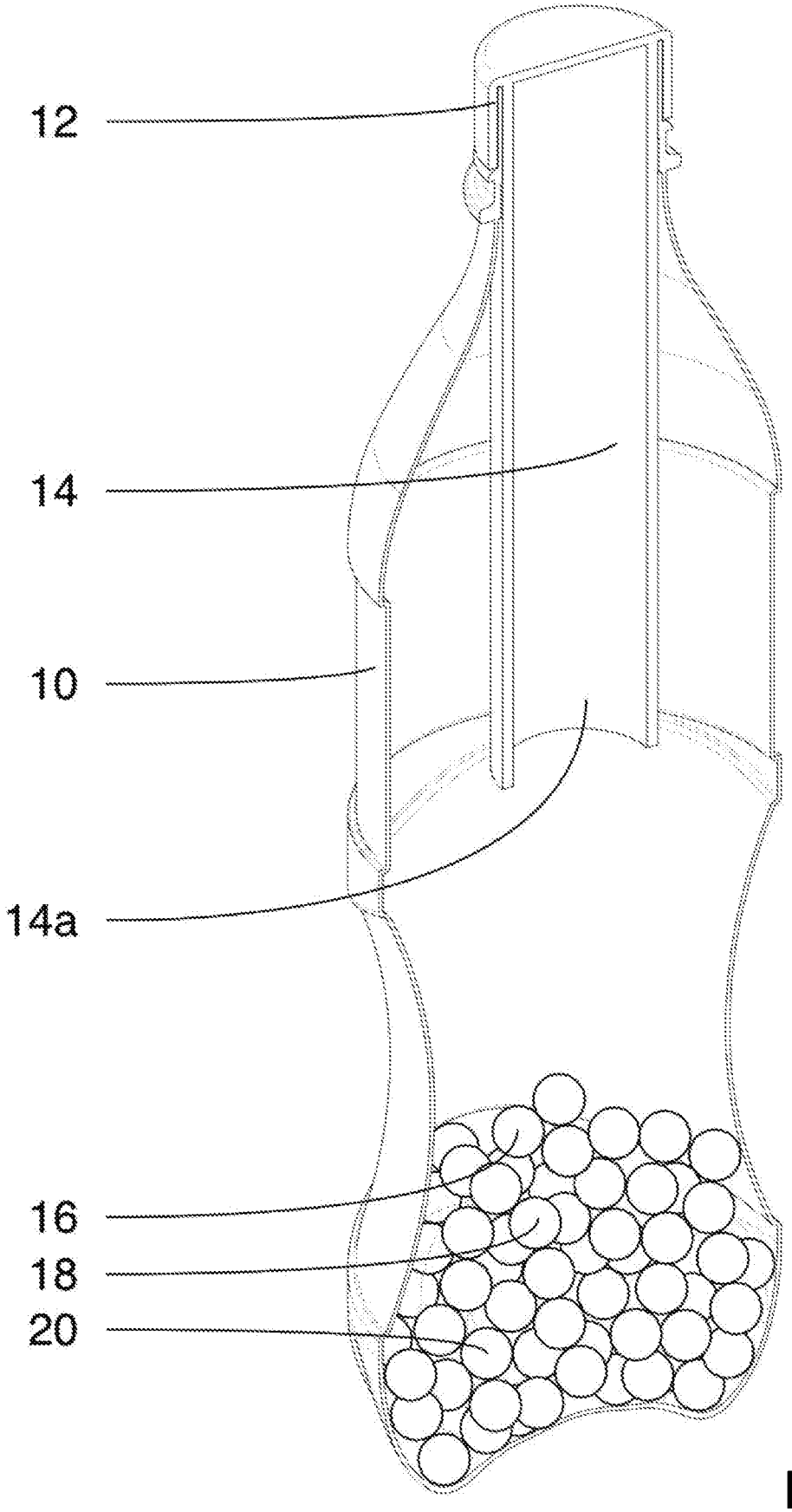

FIGS. 2 and 3 are cross sectional views of the bottle of FIG. 1. A hollow cylindrical tube of plastic can be fused and connected to one end of the bottle. The tube can be clear plastic, or it can be partially or coordinated in colour to the cap and or bottle. The tube may be as wide as the bottle neck will allow. The cylinder will be wide enough to hold small plastic balls or other small plastic tokens or objects that are free floating inside the bottle.

Tube 14 is defined by a tube wall and has an open end 14*a* extending partway into bottle 10. In the embodiment shown in FIGS. 2 and 3, the tube 14 is fusedly attached to cap 12. The opening of the bottle 10 is sealed by the cap and the tube. The open end 14*a* of the tube 14 is not in contact with the base 17 of the bottle 10 and instead there is a gap between the open end 14*a* and the base 17. The tube preferably protrudes into the bottle space to a length equal to or under the normal label position. The tube can extend at least about 80, 70, 60, 50, 40, 30 or 20% of the total available distance into the bottle.

A space 19 is defined between the wall 11 of the bottle 10 and the tube wall 14. The space is around the whole periphery of the tube wall 14. The space around the outside of the tube 14 does not need to be equal with respect to the circumferential distance of the bottle wall. The tube 14 is shown in the Figures as cylindrical, but it can have any cross-sectional shape including triangular, star-shaped or hexagonal. The tube is shown as coaxial with a longitudinal axis of the bottle, but the tube could be offset at some other angle relative to the longitudinal axis. The bottom of the tube can substantially horizontal as shown in the Figures, or off-set as desired to some other angle relative to horizontal.

Figure 5:
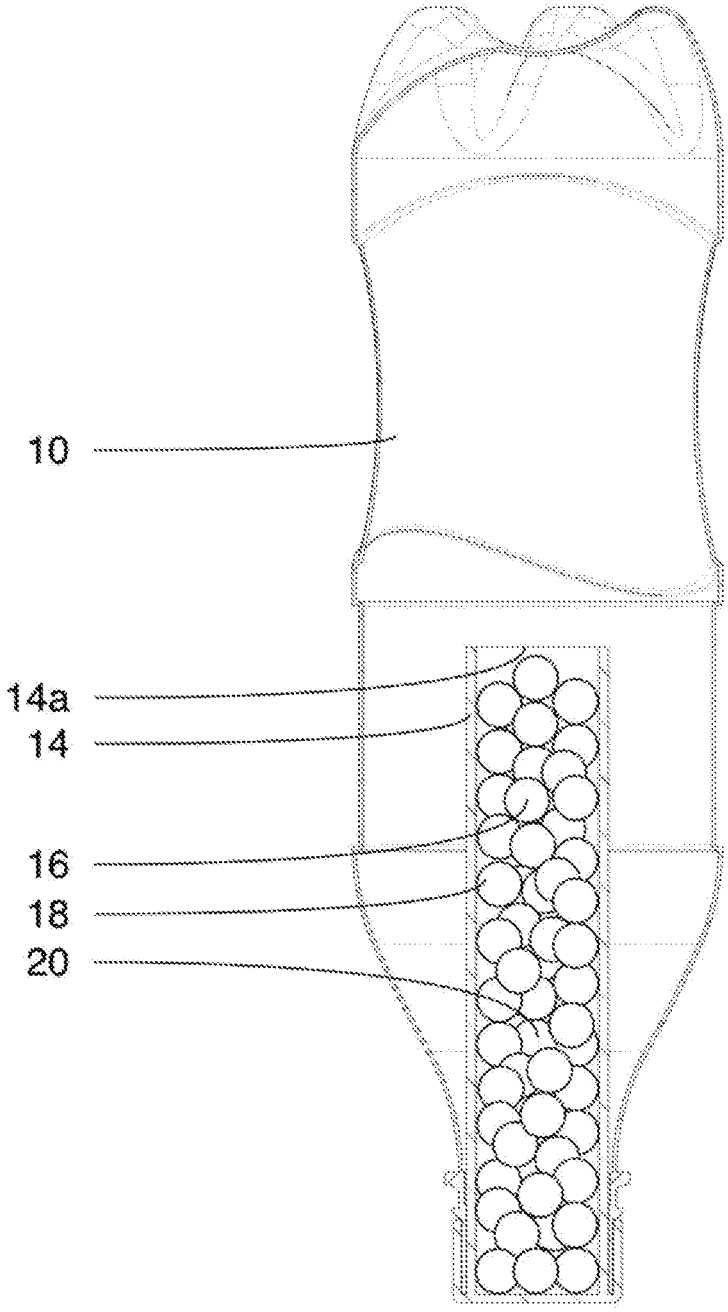
FIG. 5 shows a cross section of the bottle toy with all tokens in the tube.

There are one or more tokens 16, 18, 20 encapsulated inside the bottle 10. The number of balls or token objects in the bottom of the bottle can be as low as one or can be the same as the number of "feet" on the bottle. The maximum count number may be the number of balls or tokens that can be accommodated within the tube (FIG. 5).

Figure 6:
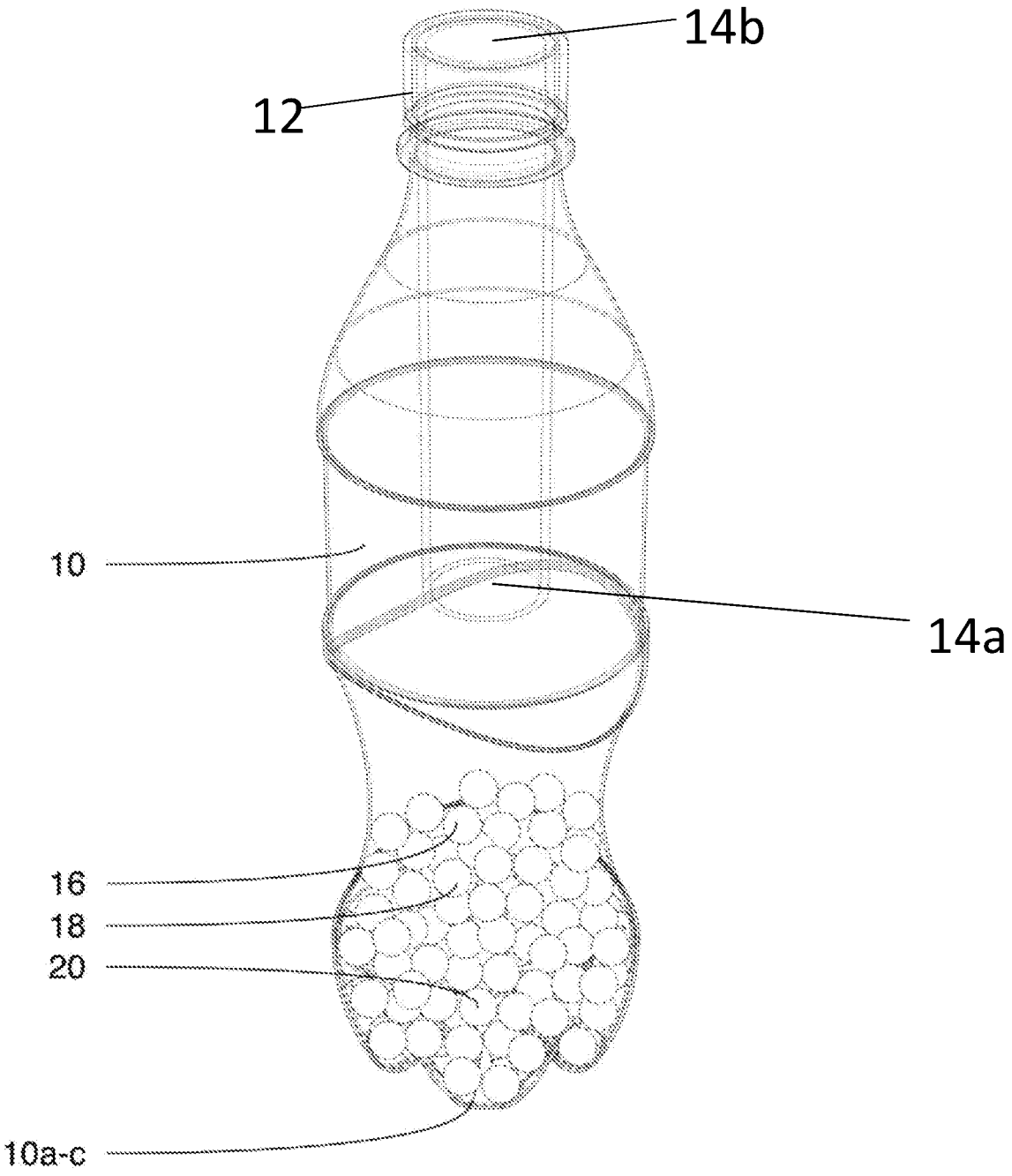
FIG. 6 shows the bottle toy in an upright position.
Figure 7:
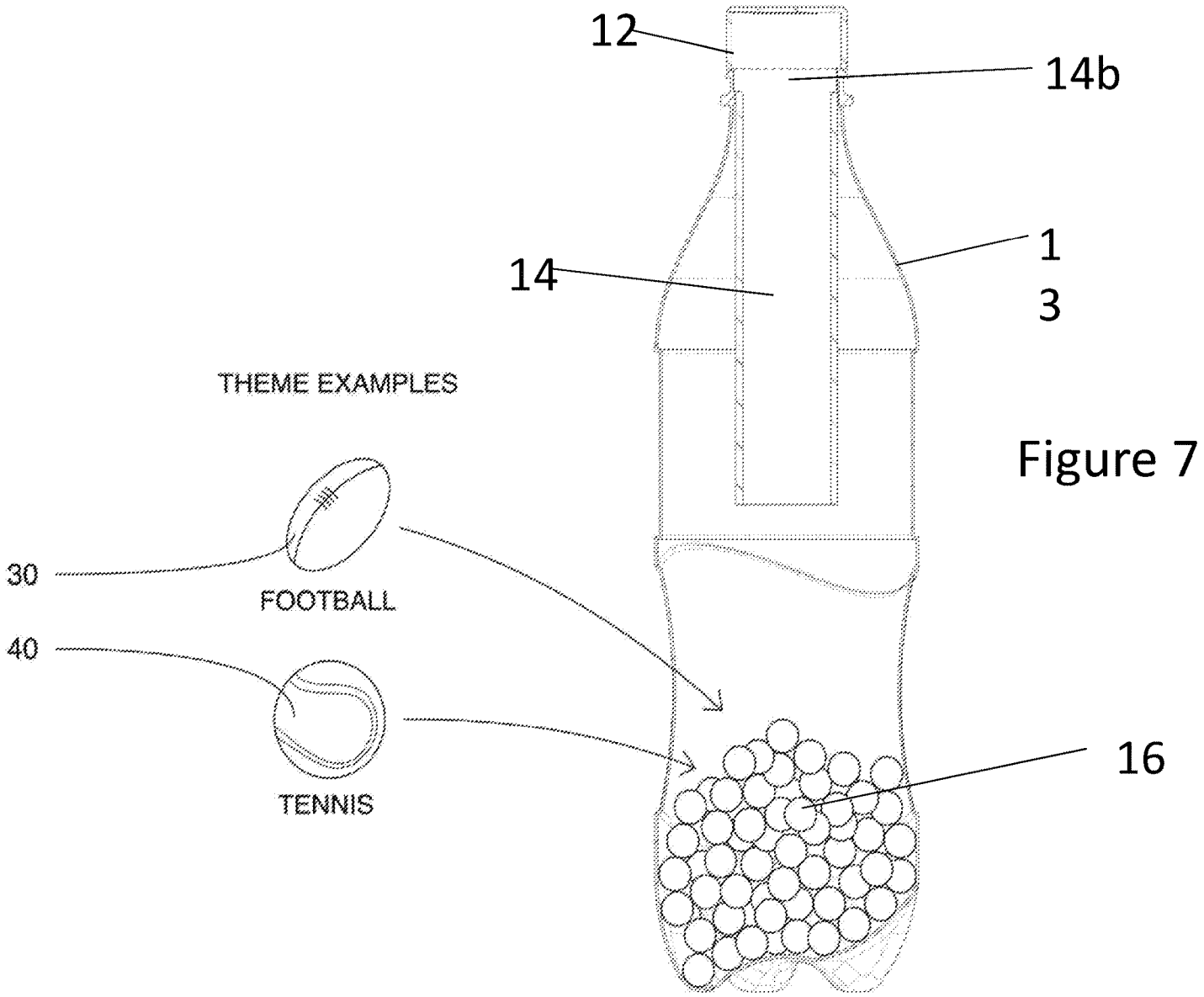
FIG. 7 shows tokens used for different marketing campaigns.

FIG. 6 shows bottle toy 10 in an upright display or sale position. All the tokens 16-20, etc are shown distributed and resting in the 'feet' 10*a-c* of the base portion 17 of the toy. The number of tokens can be predetermined and measured into the bottle prior to use. FIG. 7 shows tokens 30, 40 used for different marketing campaigns. Suitably, the shape and configuration of the tokens can reflect a popular character marketing or merchandising theme. In the case of sporting events such as tennis or rugby, the tokens can be appropriately configured to resemble a miniature tennis ball 30 or rugby football 40. The advertising and marketing possibilities are endless. A toy can even be sent to the International Space Station, perhaps with very small rockets or space shuttles inside the bottle just for them to be played with in zero gravity. If a production of the well-known musical play, "CATS" were in town, one could envisage mini "cats eye" marbles as tokens. Likewise, for Halloween it would lend itself to little figures of black cats, hats, witches cauldrons etc. The bottle toys could easily become collectables. A water bottle toy for example could have miniature clear plastic ice cubes, etc.

Figure 4:
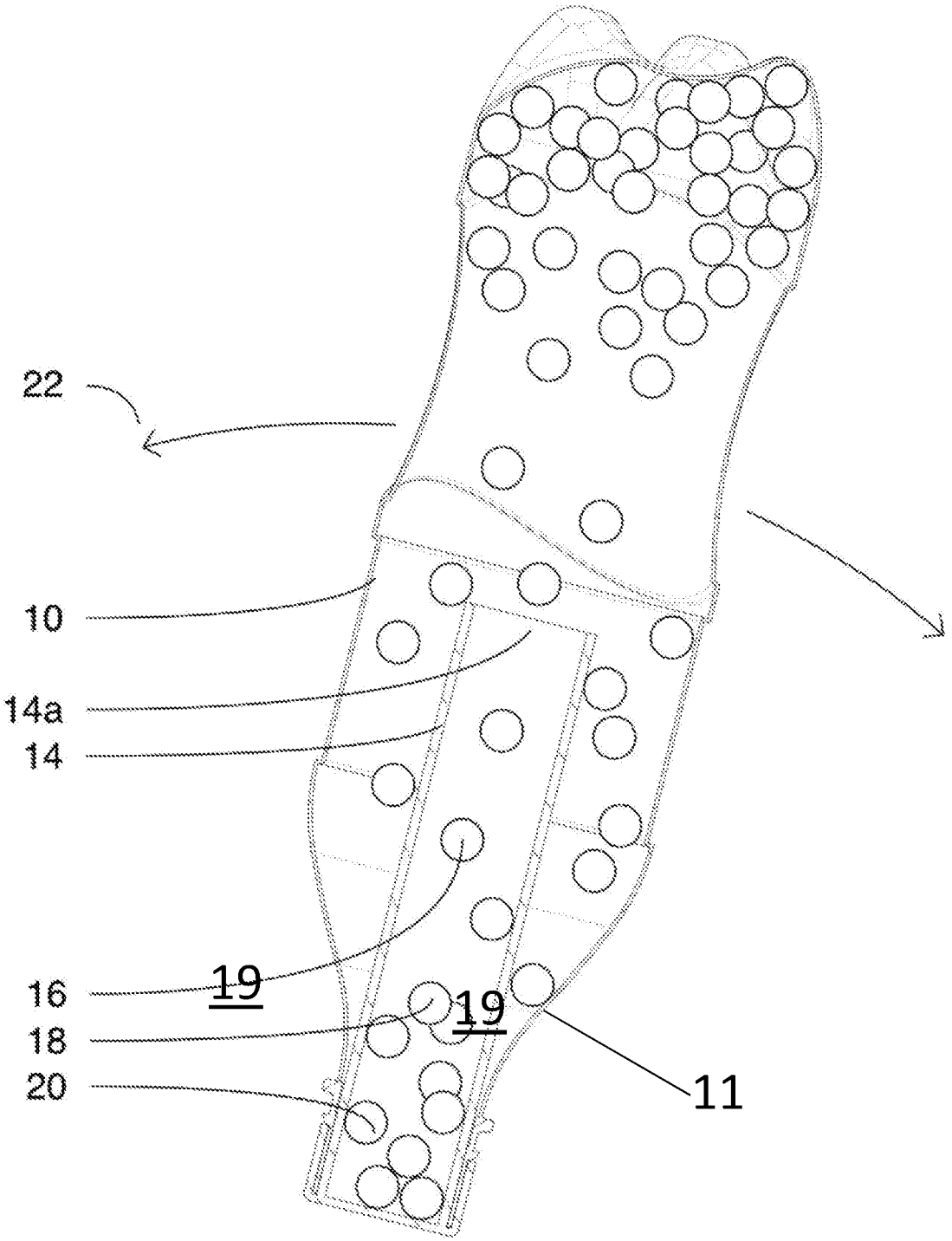
FIG. 4 shows a cross section of the bottle toy in use.

FIG. 4 shows a cross section of bottle toy 10 in use wherein by inverting the toy and or by shaking the toy as shown by arrow 22 typically in side to side or an up and down motion or a combination thereof causes one or more tokens 16, 18, 20 to enter tube 14 via open end 14*a*. Advantageously, when the cap is in place and the opening of the receptacle is closed, inversion of the receptacle causes some of the tokens to enter the open end 14*a* of the tube 14. Upon inversion or shaking, some of the tokens will also inevitably pass into the space 19 defined between the wall of the receptacle body 11 and the tube wall 14.

The area defined by the tube 14 may only permit a certain number of tokens to be contained within the tube before no further tokens can fit. The size, and/or shape and configuration of the tokens 16, 18, 20 can be varied to vary the amount that can be received into the tube 14. In some embodiments, the number of tokens 16, 18, 20 in the bottle 10 can be larger than the number of tokens that can fit into the tube 14. The bottle toy can comprise a game the aim of which is to move all of the tokens 16, 18, 20 into the tube 14 by moving the bottle 10 e.g. by inverting and or shaking it, while attempting to avoid or at least reduce the number of tokens 16, 18, 20 entering into the space 19 around the outside periphery of the tube 14.

Preferably, the length of the tube and/or shape and configuration of the open end of the tube is varied during manufacture to either change the amount of tokens that can be received by tube and or to vary the degree of difficulty in using the toy. The degree of difficulty can be tested during manufacture of the toy. FIG. 5 shows a cross section of the bottle toy 10 with all tokens 16-20 etc. in the tube. This can be considered to be a successful outcome of playing the game. The length of tube 14 and shape and configuration of open end 14*a* can varied for different toys to vary the level of playing difficulty. In addition or in the alternative, the size, and/or shape and configuration of the tokens could also be varied for toys of different levels of playing difficulty. In some embodiments, larger tokens may make the toy easier to use.

In another aspect, the invention resides in a game played using the toy as herein disclosed with the objective of locating a maximum number of tokens in the tube optionally within a predetermined period of time. A leaflet could be sold with the toy, or the toy could be otherwise marked with a time that would be considered to be a winning time. Optionally, the toy comes pairable with an app that allows the user access to additional feature of the game including a means for recording personal best times for getting all tokens into the tube.

In embodiments, the cap 12 is removable from the bottle. When the cap or lid is removable, the tube may be fixed to an inner surface of the receptacle and not to the inside of the cap or lid. The tube could be sized to the maximum width of the bottle neck opening and fused to the top of the bottle neck. The lid could then be the normal screw on cap. This is shown in e.g. FIGS. 6 and 7, where the dotted line in FIG. 7 is intended to represent the lower edge wall of the cap. Upon removal of the cap 12, the opening 14*b* in the tube 14 at the neck portion 13 of the bottle permits any tokens 16 in the tube to be dispensed.

In another embodiment, the tube 14 is attached to the cap 12 so as to be closed at one end. However, when the tube 14 is attached to the cap 12, as shown in e.g. FIG. 2, the cap and tube form a unitary piece which can be removed in its entirety from the bottle. The tube 14 once removed can then be tipped to release the token from the open end 14*a* of the tube 14.

As also outlined above, the area defined by the tube 14 may only permit a certain number of tokens to be contained within the tube 14 before no further tokens can fit. In some embodiments, the number of tokens 16, 18, 20 in the receptacle can be larger than the number of tokens that can fit into the tube 14. Thus, opening the receptacle and removing the tokens from the tube 14 allows a fixed dose or serve of the tokens to be released to the user. The toy may thereby act as a measuring device. In other embodiments, the number of tokens 16, 18, 20 in the receptacle can be about the same as the number of tokens that can fit into the tube 14. This is shown in FIG. 5. Thus, the bottle can represent a single serve of the tokens. An alternative use for the toy bottle therefore may be as a novelty food dispenser wherein the tokens such as the miniature tennis balls or footballs are actually edible sweets. This would involve the same design. The user will only eat as many he or she can make available by manoeuvring the sweets into the tube; the rest will remain in the bottle neck region 19 around the tube 14. The bottle may also contain many more sweets than will fit in the tube. However, only the number of sweets in the tube will drop out when the lid is opened. The dispenser toy would be played with in exactly the same way as the bottle toy described above however the tokens would be edible. The possible shapes and colours of the bottles could be infinite. The tokens inside would be food, not plastic and may include gumballs, little solid candy hearts, miniature black liquorice bottles etc. This product will have the same overall marketing potential as the bottle toy but the tokens can be adapted to coincide with a specific festival or theme e.g. little sweet turkey roasts for Thanksgiving etc. The tokens can be of different shapes. The average size of the tokens can be, in at least in one length direction, the tokens are at least one quarter, one third or one half of the diameter of the tube. The tokens can have an average size, e.g. diameter or length direction of at least about 2, 3, 4, 5, 6, 7, 8, 9 or 10 mm. The tokens are not intended to be granular, like grains of salt or sugar, because the tokens should be movable within the receptacle in a non-fluid like manner. The toys filled with tokens may be freely given away during a marketing strategy. Alternatively, at least one product must be purchased to obtain them. Manufacturers can flood the world with these toys.

The writing on the toy can match an existing product or be varied to match a particular promotion. The wording can include extra promotional symbols and the plastic balls/objects may be selectively matched e.g. hearts; miniature little white bottles; zeros; little miniature polar bears; soccer balls to various flags or national colour schemes. For commercially targeted festivals such as Chinese New Year, there could be little lanterns, the Chinese animal for that year; the Sign for that year or miniature lucky Chinese gold coins. (FIG. 7).

Printing from an existing product could be transferred to a clear plastic bottle and the solid background colour of the bottle itself could be transferred to the cylinder, lid, and tokens or balls. As an example, gold lid, gold tube, and gold soccer balls instead of a gold bottle. A skeleton form of the promotional gold bottle can appear on the clear plastic bottle either in a contrasting colour or in gold lettering itself. The ball or token colour can match an actual product line colour. E.g. red, black, green, white, etc The clear or transparent toy can resemble or is an empty well known soft drink bottle having a cap or lid 12 ordinarily used with the actual bottle of a beverage being advertised and marketed. The toy will naturally carry some of the manufacturer's existing product labelling. It will appear to be the product itself without containing the drink, however the colouring and livery may be designed to represent the actual liquid contents. (FIG. 1). In effect, the toy will carry the same colour scheme and have the same lid colour to mimic the product that the bottle normally contains as a drink. The skeleton labelling on the bottle may not include all the small print usually associated with the bottle contents nor the address of the manufacturer. There will be no need to provide such wording e.g. the contents list will not be applicable to the toy either as it has no liquid content.

To use the toy, the player needs to see through the bottle without being obscured by writing. The bottle will display the trade mark of the manufacturer along with any promotional wording or symbolic information required. In this way, the toy will represent a sales promotion item for marketing purposes.

The toy is played by holding it upside down by the bottle neck. (FIG. 4). This allows anyone shaking the toy to manoeuvre the balls or tokens from the bottom of the bottle into the cylindrical tube. The tokens may match the theme of the bottle and/or the manufactured item. The bottles are shaken in any direction until all the tokens are located within the tube. The user will still be able to see the tokens in the bottle clearly through the skeleton markings appearing on the bottle. The idea is that visibility will not be hampered by the amount of writing or illustration on the bottle itself. There are no solid coloured background labels on the toy which would hinder its function or obstruct the view through the bottle. The use of classic shapes, name brands and their associated colours on the toy will make it easy for all players to identify with.

The artwork on clear bottles will promote the product. Even a future product could be released as a bottle toy to create interest ahead of the actual release of a new product. The toys may even become a collectable series. Advertising on bottles can go on forever for any occasion being celebrated around the world. Large letters could be accommodated and would also be easy to write on clear bottles. It is envisaged these toys may be packaged with a number of drinks sold or given away with six or dozen packed cartons. In summary, the bottle toy is ideally an existing clear plastic drink bottle carrying the manufacturers brand fitted with an internal tube, filled with miniature tokens to become a challenging item of amusement to promote the product normally dispensed in the bottle itself.

The design can be modified with a screw-top lid as an edible sweets dispensing toy which delivers sweets commensurate with the skill level of the player. In this case the tube may be attached to an inner surface of the neck of the bottle and not the lid itself, thus allowing the sweets to be dispensed as they are collected in the tube. The dispenser toy is preferably also refillable with fresh supplies of sweets. While sealing the bottle toy makes it safe for everyone's use regardless of ability to use the promotional toy, offering the toy as a re-usable dispenser of sweets with a removable screw top is also an innovative way of using an existing product.

It will of course be realized that while the foregoing has been given by way of illustrative example of this invention, all such and other modifications and variations thereto as would be apparent to persons skilled in the art are deemed to fall within the broad scope and ambit of this invention as is herein set forth.

In the specification the terms "comprising" and "containing" shall be understood to have a broad meaning similar to the term "including" and will be understood to imply the inclusion of a stated integer or step or group of integers or steps but not the exclusion of any other integer or step or group of integers or steps. This definition also applies to variations on the terms "comprising" and "containing" such as "comprise", "comprises", "contain" and "contains."

What is claimed is:

1. A product advertising and marketing toy comprising:

a transparent receptacle defined by a wall, the transparent receptacle comprising a neck portion and a base portion;

a single tube having an internal volume defined by a first end and an open second end, the first end of the single tube coupled with the neck portion of the transparent receptacle;

a cap configured to close the first end of the single tube before, after and during use of the toy;

the open second end of the single tube extending partway into the transparent receptacle and being the only opening in the single tube before, after and during use of the toy; and wherein a space is defined between the wall of the transparent receptacle and the single tube, the space being around the whole periphery of the single tube;

wherein a space is defined between the open second end of the single tube and the base portion of the transparent receptacle;

tokens encapsulated within the transparent receptacle, wherein the volume taken up by the tokens corresponds to the internal volume of the single tube;

wherein the receptacle is configured to, when shaken in one of a side to side motion, an up and down motion, an inversion motion, or a combination thereof, to cause at least some of the tokens to enter the second end of the single tube.

2. The toy of claim 1, wherein the transparent receptacle is an empty beverage container of a beverage being advertised or marketed.

3. The toy of claim 1, wherein the cap is an actual cap ordinarily used with the beverage container.

4. The toy of claim 1, wherein the single tube provided in the transparent receptacle is coaxially aligned with the longitudinal axis of the receptacle.

5. The toy of claim 1, wherein the single tube extends about halfway into the transparent receptacle.

6. The toy of claim, 1 wherein the single tube is clear or transparent.

7. The toy of claim 1, wherein the shape and configuration of the tokens reflects a contemporaneous or popular character marketing or merchandising theme.

8. The toy of claim 1, wherein the single tube is fixed to and is integral with the cap.

9. A method of playing a game using a toy, the method comprising:

providing a toy comprising:

a transparent receptacle defined by a wall, the transparent receptacle comprising a neck portion and a base portion;

a single tube having an internal volume defined by a first end and an open second end, the first end of the single tube coupled with the neck portion of the transparent receptacle;

a cap configured to close the first end of the single tube before, after and during use of the toy;

the open second end of the single tube extending partway into the transparent receptacle and being the only opening in the single tube before, after and during use of the toy;

wherein a space is defined between the wall of the transparent receptacle and the single tube, the space being around the whole periphery of the single tube; and wherein a space is defined between the open second end of the single tube and the base portion of the transparent receptacle;

tokens encapsulated within the transparent receptacle, wherein the volume taken up by the tokens corresponds to the internal volume of the single tube;

locating a maximum number of tokens in the tube within a predetermined period of time by shaking the receptacle in one of a side to side motion, an up and down motion, an inversion motion, or a combination thereof to cause at least some of the tokens to enter the tube via the open end.

10. A kit to convert a transparent beverage receptacle into a product advertising and marketing toy, transparent receptacle defined by a wall, the transparent receptacle comprising a neck portion and a base portion; and comprising:

a single tube having an internal volume defined by a first end and an open second end, the first end of the single tube coupled with the neck portion of the transparent receptacle;

a cap configured to close the first end of the single tube before, after and during use of the toy; and the open second end of the single tube extending partway into the transparent receptacle and being the only opening in the single tube before, after and during use of the toy;

wherein a space is defined between the wall of the transparent receptacle and the single tube, the space being around the whole periphery of the single tube; and wherein a space is defined between the open second end of the single tube and the base portion of the transparent receptacle;

tokens encapsulated within the transparent receptacle, wherein the volume taken up by the tokens corresponds to the internal volume of the single tube;

wherein the single tube is further configured to be fitted into the transparent receptacle such that the first end couples with the neck portion of the receptacle without inhibiting the receptacle cap being attached to the opening, and the second end of the tube extends partway into the transparent receptacle; and wherein upon shaking the converted receptacle in one of a side to side motion, an up and down motion, an inversion motion, or a combination thereof, at least some of the tokens are able to enter the open second end of the tube.

11. The kit of claim 10, wherein the tube is configured to be coupled with the first end of the neck portion of the receptacle by being fused, glued or otherwise fixedly attached thereto.

* * * * *